US007823299B1

(12) United States Patent
Brigham

(10) Patent No.: US 7,823,299 B1
(45) Date of Patent: Nov. 2, 2010

(54) INTERCHANGEABLE FLIP-FLOP/SANDAL

(76) Inventor: John P. Brigham, 10256 County Rd. 117, Glenwood Springs, CO (US) 81601

( * ) Notice: Subject to any disclaimer, the term of this patent is extended or adjusted under 35 U.S.C. 154(b) by 866 days.

(21) Appl. No.: 11/703,441

(22) Filed: Feb. 7, 2007

(51) Int. Cl.
*A43B 3/24* (2006.01)
*A43B 3/12* (2006.01)

(52) U.S. Cl. ..... 36/101; 36/100; 36/11.5

(58) Field of Classification Search ..... 36/100, 36/101, 11.5
See application file for complete search history.

(56) References Cited

U.S. PATENT DOCUMENTS

| | | | | |
|---|---|---|---|---|
| 366,266 | A | 7/1887 | Smithers | |
| 1,686,175 | A | 10/1928 | Read | |
| 2,062,909 | A | 5/1935 | Kengay et al. | |
| 2,069,752 | A | 2/1937 | Dorr | |
| 2,736,110 | A | 2/1956 | Hardimon | |
| 3,015,896 | A | 1/1962 | Breslow | |
| 3,305,947 | A | 2/1967 | Kalsoy | |
| 3,336,683 | A | 8/1967 | Schellkopf | |
| 3,455,037 | A | 7/1969 | Vlas et al. | |
| 3,570,147 | A | 3/1971 | Chiu | |
| 5,615,496 | A | 4/1997 | Sharpstein | |
| D422,780 | S | 4/2000 | Aguerre | |
| 6,237,249 | B1 | 5/2001 | Aguerre | |
| 6,543,157 | B2 | 4/2003 | Pan | |
| 6,993,858 | B2 | 2/2006 | Seamans | |
| D517,788 | S | 3/2006 | Seamans | |
| D517,789 | S | 3/2006 | Seamans | |
| D517,790 | S | 3/2006 | Seamans | |
| 7,222,442 | B2 * | 5/2007 | Hillyer et al. | 36/11.5 |
| 7,331,122 | B2 * | 2/2008 | Januszewski et al. | 36/11.5 |
| 2002/0124433 | A1 * | 9/2002 | Pan | 36/11.5 |
| 2005/0252036 | A1 * | 11/2005 | Laska | 36/11.5 |
| 2006/0075656 | A1 | 4/2006 | Januszewski et al. | |
| 2006/0090374 | A1 | 5/2006 | Hillyer et al. | |
| 2008/0155860 | A1 * | 7/2008 | Tai | 36/101 |
| 2008/0168682 | A1 * | 7/2008 | Le | 36/101 |

FOREIGN PATENT DOCUMENTS

| | | |
|---|---|---|
| JP | 19920316983 | 6/1994 |

* cited by examiner

*Primary Examiner*—Ted Kavanaugh
(74) *Attorney, Agent, or Firm*—Bradley Arant Boult Cummings, LLP; T. Gregory Peterson

(57) ABSTRACT

The present disclosure describes a novel interchangeable flip-flop/sandal footwear that is capable of interconversion between a flip-flop and a sandal by movement of a heel and/or forefoot band between a first stored position and a second in-use position. In the first stored position, the heel and/or forefoot band is movably stored adjacent to the heel portion of the sole. In the second in use position, the heel and/or forefoot band is placed on the user's foot as described herein. In one embodiment, the flip-flop/sandal comprises a sole, a forefoot cover, at least one of a heel band and a forefoot band, each of which being capable of movement between a first stored and a second in-use position, at least one central member rotatably secured and received by the sole, said central member being in removable communication with the heel band and/or forefoot band and at least one void or indentation in the sole to rotatably receive and secure the central member.

42 Claims, 10 Drawing Sheets

INTERCHANGEABLE FLIP-FLOP/SANDAL

FIELD OF THE DISCLOSURE

The displayed articles of footwear relate to the art of footwear for flip-flop and sandal design and manufacturing. Further the disclosure relates to an option in which a flip-flop may also be rearranged into a sandal type product at the user's will. A hybrid combination allows a mobility option of a secured or unsecured heel portion of the flip-flop/sandal's sole to the heel portion of the user's foot.

BACKGROUND ART

The "flip-flop" is typically designed for convenience and easy access in the application of inserting or removing the "flip-flop" footwear article on or off of the human foot. This is accomplished by inserting the forefoot portion of the human foot into the forefoot cover of the flip-flop wherein the forefoot cover of the flip-flop secures the forefoot portion of the user's foot to the forefoot section of the flip-flop's sole or foot bed. This as a result allows the heel portion of the user's foot to operate freely from the heel section of the flip-flop's sole. It is this design feature of the flip-flop that is great for convenience and leisure wearing. However, the flip-flop design also creates a number of difficulties with keeping the flip-flop securely attached to the user's foot when participating in certain activities such as rigorous uphill or downhill hiking, walking or swimming in water or simply trying to run or move somewhere quickly.

"Sandals" on the other hand are typically designed with heel covers and heel bands that are meant to secure the heel section of the sandal's sole to the heel portion of the user's foot. This allows for a much more all around secure fit of the user's foot to the foot bed of the sandal's sole. The sandal design also prevents the sole from popping off of the user's foot. However, the design of the sandal lacks in accessibility and convenience when applying the footwear article to the human foot.

The difference between these two articles of footwear in the past have driven users to buy one design for convenience and accessibility and another design for security and stability. In addition, the users who want a combination of both convenience as well as security in their foot wear product must then alternate between the flip-flop and the sandal to account for their needs.

The flip-flop/sandal addresses the design inconvenience between the security of the sandal versus the access convenience of the flip-flop. The flip-flop/sandal is designed to operate as an easily accessed flip-flop when being used for leisure activities. However, when more rigorous activities come about, the flip-flop can then quickly and easily be rearranged into a sandal unit that will securely cling to the user's foot offering a much more stable footwear environment.

SUMMARY OF DISCLOSURE

The present disclosure describes a novel interchangeable flip-flop/sandal footwear product that is capable of interconversion between a flip-flop and a sandal by movement of a heel and/or forefoot band between a first stored position and a second in-use position. In the first stored position, the heel and/or forefoot band is movably stored adjacent to the heel portion of the sole. In the second in-use position, the heel and/or forefoot band is placed on the user's foot as described herein.

In one embodiment of the present disclosure, the flip-flop/sandal comprises a sole, at least one of a heel band and a forefoot band, each of which being capable of movement between a first stored and a second in-use position, a central member rotatably secured and received by the sole, said central element being in removable communication with the heel band and/or forefoot band and a central member receiver in the sole to rotatably receive and secure the central member. The flip-flop/sandal may further comprise additional elements known in the flip-flop and/or sandal art, such as, but not limited to, a forefoot cover.

The sole may be designed or molded into a variety of different shapes and forms as is known in the art and the exact configuration of the sole is not critical to the present disclosure. The sole comprises a forefoot portion, a heel portion, a sidewall and a top and bottom side. The sole comprises a central member receiver to rotatably secure and receive the central member. In one embodiment, the central member receiver comprises a void or channel extending laterally through and across the sole to rotatably receive and secure the central member. In an alternate embodiment, the central member receiver comprises an indentation or recess extending laterally across the top or bottom portion of the sole to rotatably receive and secure the central member. The sole may further comprise a receiving element to reversibly store the heel and/or forefoot band. In one embodiment, the receiving element is a ledge, shelf or similar structure formed along at least a portion of the heel portion of the sole, said ledge, shelf or similar structure being sized to reversibly store the heel and/or forefoot band. The portion of the heel portion adjacent to the receiving element may have a concave, convex or angled shape along at least a portion of the receiving element in order to aid in storing the heel and or forefoot band. The form of the receiving element may take a number of forms as illustrated herein or as would be known to those of skill in the art. Alternatively, the heel and or forefoot band may be placed adjacent to the heel portion of the sole.

The forefoot cover may exist over the forefoot portion of the sole and may be connected to the sole using conventional methods known in the art. In an exemplary embodiment of the disclosure, the forefoot cover is designed in a thong type fashion. However, the forefoot cover may be designed in a variety of different forms to best fit the needs of the user and the exact form of the forefoot cover is not critical to the present disclosure.

The central member functions to allow the movement of the heel and/or forefoot bands between the first stored and the second in-use position. As discussed above, the central member is rotatably secured and received by the sole and is in removable communication with the heel band and/or forefoot band. In one embodiment, the central member is a pin, rod, strap or similar element, said pin, rod, strap or similar element being in removable communication with the left and right ends of the heel band and/or the forefoot band. As discussed above, the central member central member receiver extending through the sole or formed along the top or bottom portions of the sole.

The heel and forefoot bands may rest upon the rear rim of the sole's heel section when the flip-flop/sandal is in flip-flop mode. When the interchangeable flip-flop/sandal is in sandal mode, the heel and/or forefoot bands are pulled out from the sole's rear rim and placed upon the heel and forefoot arch of the user's foot. The rear rim of the sole's heel section may take various forms and shapes depending upon the fit of the heel and or forefoot bands that rest upon the sole.

The flip-flop/sandal is designed with the option to operate either as a flip-flop or as a sandal. When in flip-flop mode the flip-flop/sandal's heel and or forefoot bands are in the first stored position, the heel and/or forefoot bands being stored in the receiving element or resting along at least a portion of the heel portion of the sole. In this mode, the interchangeable flip-flop/sandal is secured to the user's foot by the forefoot cover, thereby providing un-obstructed heel access into the interchangeable flip-flop/sandal. When in sandal mode the interchangeable flip-flop/sandal's heel and or forefoot bands are placed in the second in-use position by moving the heel and/or forefoot bands from their first position in the receiving element or along the heel portion to their appropriate position on the foot of the user. In this mode, the interchangeable flip-flop/sandal is secured to the user's foot by the forefoot cover and the heel and/or forefoot bands, thereby providing more stability for the heel area of the user's foot when engaging in more rigorous activities.

DETAILED DESCRIPTION

Figure 1A:
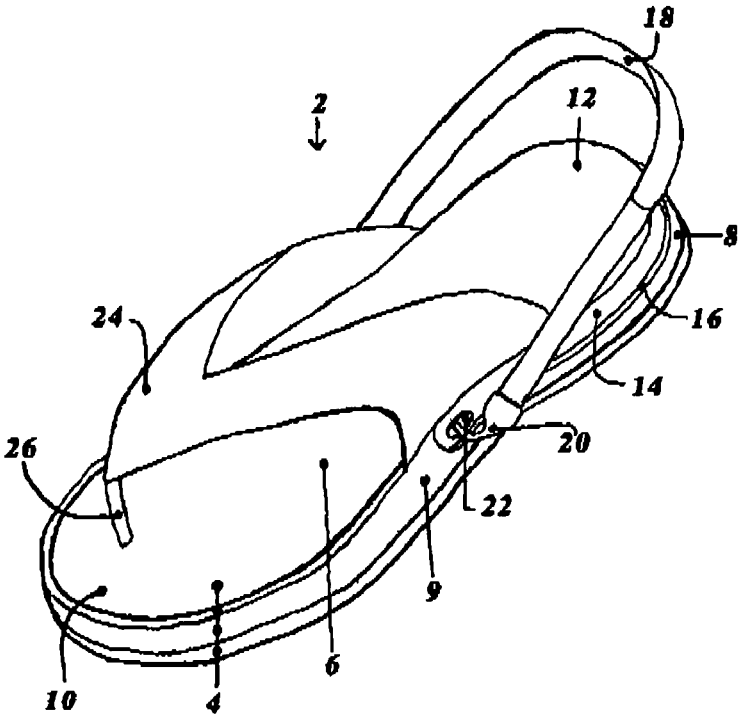
FIG. 1*a* is an angled 3-D perspective view of an interchangeable flip-flop/sandal comprising a heel band and forefoot cover, with the heel band in the second in-use position in accordance with one embodiment of the present disclosure.
Figure 1B:
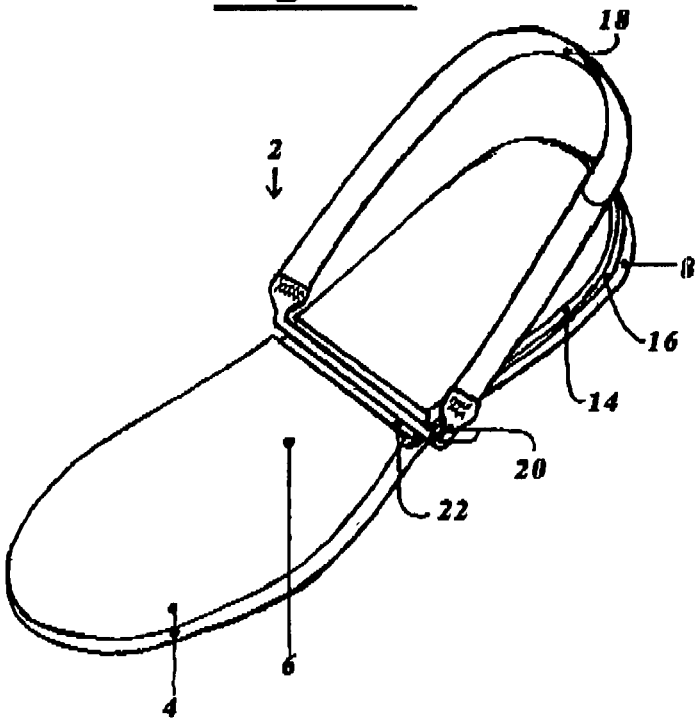
FIG. 1*b* is a sectional 3-D perspective view of an interchangeable flip-flop/sandal comprising a heel band and forefoot cover, with the heel band in the second in-use position in accordance with one embodiment of the present disclosure.

The present disclosure describes a novel interchangeable flip-flop/sandal footwear that is capable of interconversion between a flip-flop and a sandal by movement of a heel and/or forefoot band between a first stored position and a second in-use position. In the first stored position, the heel and/or forefoot bands are removably stored by a receiving element. The receiving elements may by located at various positions on the interchangeable flip-flop/sandal as illustrated herein. In the second in-use position, the heel and/or forefoot bands are placed on the user's foot as described herein. Several embodiments of the disclosed footwear are described herein to further illustrate the operative concepts of the footwear.

General Description of the Footwear

With reference to figures, in one embodiment of the present disclosure, the interchangeable flip-flop/sandal, generally designated 2, may comprise the following elements: a sole 4, a forefoot cover 24, at least one of a heel band 18 and a forefoot band 28, each of which being capable of movement between a first stored and a second in-use position, at least one central member 20, said central member 20 being in communication with the heel band 18 and/or forefoot band 28, at least one central member receiver 22 in the sole to rotatably receive and secure the at least one central member 20 and a receiving element, referred to herein with various designations, to reversibly receive the heel 18 and/or forefoot 28 band when the foregoing are in the first stored position.

Sole

The sole 4 may be made of a middle base layer known as the midsole 8, an upper surface layer known as the foot bed 6 and a bottom layer or outsole 9. The foot bed 6 may be formed from rubber, leather, synthetic fabrics, or other materials that are known to the art. The midsole 8 and outsole 9 may be constructed from the same material or a more durable material such as ethyl vinyl acetate (EVA), rubber, vulcanized rubber, polyurethane, dual density SSR, or any other material known to the art for sole construction. The foot bed 6 may be adhered into or onto the midsole 8, and the midsole 8 may be adhered into or onto the outsole 9. The method of construction of the sole of the interchangeable flip-flop/sandal may vary depending on the design and various methods that are known within the art of flip-flop and sandal manufacturing. The foot bed 6 of the interchangeable flip-flop/sandal 2 may be formed so as to best fit the contours of the human foot. The foot bed 6 may be formed from the same material as the midsole 8 or the outsole 9. In various embodiments of the disclosure the foot bed 6 may be altered or changed according to user comfort issues. Alternatively, the sole 4 may be one solid unit. In any of the above embodiments, the sole 4 may be made with any material and by any process known to the art.

For descriptive purposes, the sole 4 may be divided into two main sections: the rear or heel section 12 and the front or forefoot section 10. The heel section 12 is defined as the heel edge of the flip-flop/sandal (where the user's heel would rest) to approximately the center of the sole 4. The forefoot section 10 is defined as the toe edge of the flip-flop/sandal (where the user's toes would rest) to approximately the center of the sole 4. Furthermore, the side of the sole 4, whether the sole 4 is of one piece or of multi-piece construction, comprises a sidewall 14 extending from the top to the bottom of the surface. The sidewall 14 may be formed to create the receiving element 16.

In one embodiment of the present disclosure where the sole is of multi-piece construction and comprises a foot bed 6, midsole 8 and outsole 9, one or more of the foot bed 6, midsole 8 and the outsole 9 may have each different widths and/or dimensions in the forefoot section 10 and/or in the heel section 12. In this manner, the receiving element 16 may be formed around a portion or all of the sole 4. In one embodiment of the present disclosure where the sole 4 is formed from a single piece, the sidewall 14 of the sole 4 may be formed so as to create the receiving element 16 around a portion or all of the sole 4.

Forefoot Cover

The forefoot cover 24 may be used to hold the forefoot area of the user's foot within forefoot section 10 of the interchangeable flip-flop/sandal 2. The forefoot cover 24 may be secured on both the right and left side to the sole 4 using construction methods known to the art. As illustrated in FIG. 1*a*, the forefoot cover 24 is illustrated as a thong. However, the shape of the forefoot cover 24 may be modified as desired or to best fit the upper contours of the human foot. In an embodiment of the disclosure, a thong attachment 26 is attached at the apex or forth most point of the forefoot cover 24. The thong attachment 26 runs into the sole 4 in the forefoot section 10. Located in the forefoot section 10 of the sole 4, as illustrated in FIG. 2*c*, is the thong attachment void 54, which is where the end of the thong attachment 26 is inserted and secured within the sole 4 using conventional methods know to the art. The thong attachment 26 may secure the user's lateral foot movement by resting in between the user's big toe and second toe.

In an alternative embodiment, the forefoot cover 24 may be extended. As illustrated in FIG. 1*h*, a forefoot cover extension 38 may be secured to the upper portion of the forefoot cover 24. The forefoot cover extension 38 may be constructed of elastic materials. The shape or design of the forefoot cover extension 38 may be modified to best fit the upper contours of the human foot. While the forefoot cover extension 38 is illustrated as extending from the top portion of the forefoot cover 24, the forefoot extension 38 may also extend from the bottom of the forefoot cover 24.

Several different embodiments of the interchangeable flip-flop/sandal are illustrated in the figures. For example, FIG. 1*d* shows an embodiment of the convertible flip-flop/sandal 2 having a heel band 18, a forefoot cover 24, one void 22 rotatably receiving and securing one central member 20, while FIG. 1*e* shows an embodiment of the convertible flip-flop/sandal 2 having a heel band 18, a forefoot band 28, a forefoot cover 24, two voids 22*a* and *b* and two central members 20*a* and *b*. Still other embodiments of the interchangeable flip-flop sandal illustrating other features, as described herein, are further illustrated in the figures.

Central Member and Central Member Receiver

As discussed above, present disclosure describes a novel interchangeable flip-flop/sandal footwear that is capable of interconversion between a flip-flop and a sandal by movement of a heel and/or forefoot band between a first stored position and a second in-use position. The central member 20 allows the movement of the heel band 18 and/or the forefoot band 28 between the first stored and second in-use positions by serving as a pivot point for the movement of the heel band 18 and/or the forefoot band 28. The central member 20 is rotatably or non-rotatably secured to each end of at least one of the heel 18 and forefoot 28 bands. The central member may be reversibly secured to one or both ends of at least one of the heel 18 and forefoot 28 band if desired. As discussed above, the central member 20 may take a variety of forms. In certain embodiment, more than one central member may be present. It is to be understood that when more than one central member is present, the additional central member operates in the manner described herein.

The central member 20 is movably received and secured via a central member receiver 22. The central member receiver 22 may be formed as a cavity or void extending at least through a portion of the sole 4. In one embodiment, the central member receiver 22 extends laterally through the entirety of the sole 4 (see FIGS. 1*a-j*) and forms an opening on each of the left and right sides of the sole 4. The central member receiver 22 may be positioned at any place along the sole 4; however, in one embodiment the central member receiver 22 is positioned at the center of the sole 4.

In an alternate embodiment, the central member receiver 22 comprises an indentation or recess extending laterally across the top or bottom portion of the sole to rotatably receive and secure the central member. The indentation or recess forms an opening on each of the left and right sides of the sole 4.

The central member 20 may be constructed from a durable flexible material such as metals, rubber, leather, plastic, synthetic materials or other materials known within the art. In an alternative embodiment of the disclosure, the central member receiver 22 may be created in any shape, size or manner that best supports the central member 20 design or the design of the flip-flop/sandal 2. In one embodiment, the central member receiver 22 may be large enough to allow the central member 20, as well as the heel band 18 and/or forefoot band 28, to pass completely through the central member receiver 22. This may allow the user an option of replacing the central member 20 and heel 18 and/or forefoot 28 bands due to damage, fashion, or of any other purpose. In an alternate embodiment, the central member receiver 22 may be large enough to receive the central member 20 only. In yet another alternate embodiment, the central member receiver 22 may extend laterally along the length of the sole so that the central member 50 may travel laterally up or down the length of the sole 4.

Figure 1C:
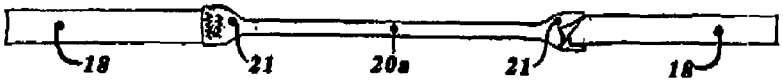
FIG. 1*c* is a top view of the central member, the central member being illustrated as a one-piece system in communication with the left and right ends of the heel band in accordance with one embodiment of the present disclosure.
Figure 1D:
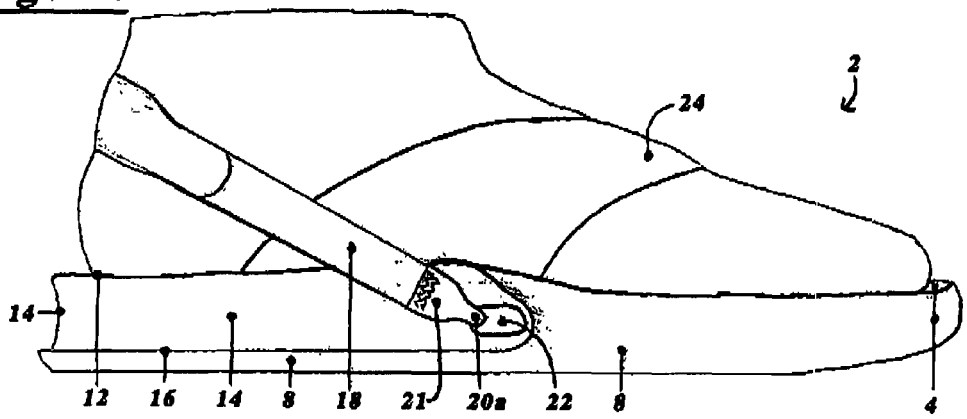
FIG. 1*d* is a side view elevation of an interchangeable flip-flop/sandal comprising a heel band and forefoot cover and a receiving element having a concave heel portion adjacent thereto, with the heel band in the second in-use position in accordance with one embodiment of the present disclosure.
Figure 1E:
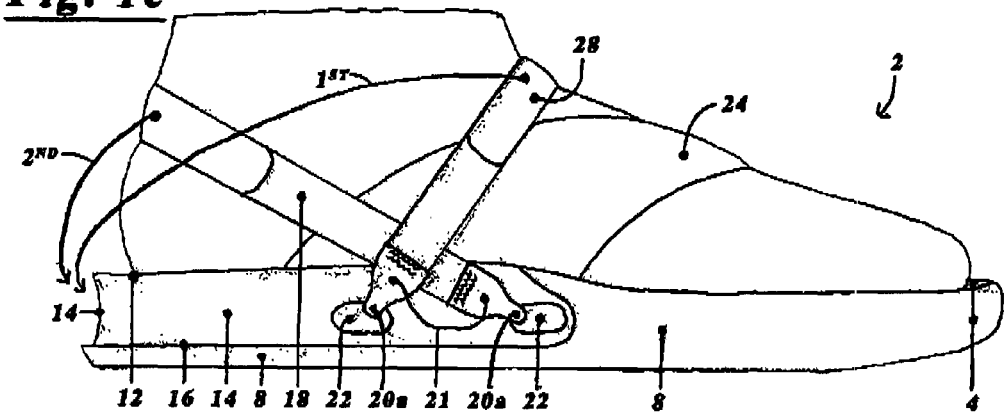
FIG. 1*e* is a side view elevation of an interchangeable flip-flop/sandal comprising a heel band, forefoot band, forefoot cover and a receiving element having a concave heel portion adjacent thereto, with the heel band and forefoot band in the second in-use position in accordance with one embodiment of the present disclosure; arrows indicate the movement of the heel and forefoot bands from the second in-use position to the first stored position.
Figure 1F:
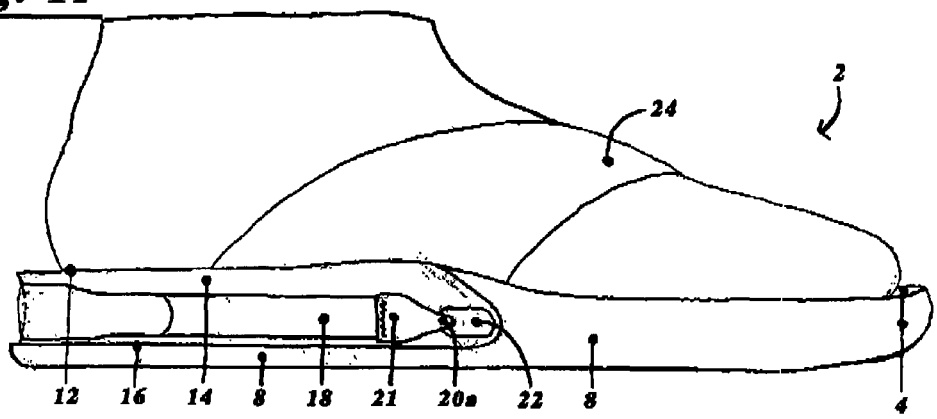
FIG. 1*f* is a side view elevation of an interchangeable flip-flop/sandal comprising a heel band and/or forefoot band, forefoot cover and a receiving element having a concave heel portion adjacent thereto, with the heel band in the first stored position in accordance with one embodiment of the present disclosure.
Figure 3A:
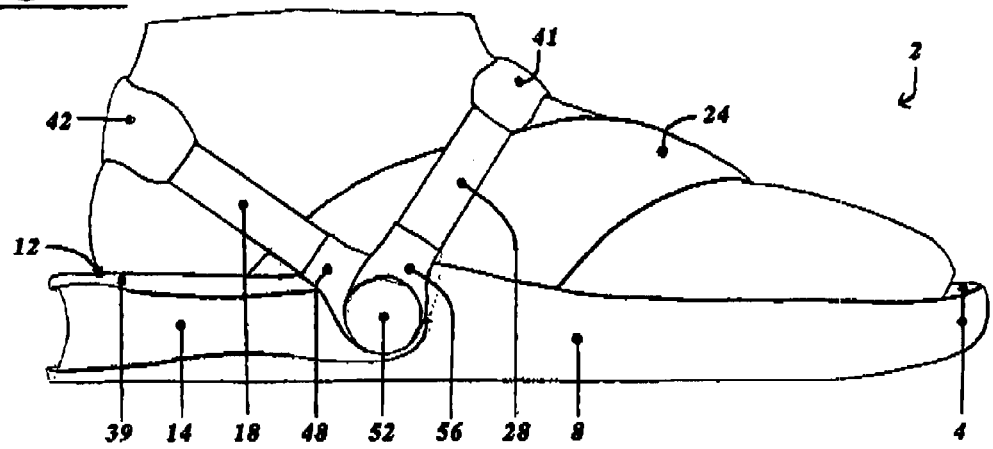
FIG. 3*a* is a side view elevation of an alternate embodiment of an interchangeable flip-flop/sandal showing the heel band and forefoot band in communication with a single central member with the heel band and forefoot band in upright positions in accordance with one embodiment of the present disclosure.

One embodiment of the central member 20 and its attachment to the heel 18 and/or forefoot 28 bands is shown in FIG. 1*c*. In this embodiment, the central member 20 is illustrated as an elongate member 20*a* with a band connecting member 21 positioned on each end of the elongate member 20*a*. Opposite ends of the heel band 18 and/or the forefoot band 28 are secured to the connecting member 21. The heel band 18 and/or the forefoot band 28 may be rotatably or non-rotatably secured to the connecting member 21. Such an embodiment is illustrated in FIG. 1*d*. The connecting member 21 may be rotatably secured or non-rotatably secured to a central member 50 as described herein. In either embodiment, the connecting member 21 may then be reversibly secured to a central member 50 and/or the heel band 18 and/or the forefoot band 28 as desired as described herein. The heel 18 and forefoot 28 bands may each be secured to a single central member 20 received by a single central member receiver 22 (FIG. 3*a*). Alternatively, the heel 18 and forefoot 28 bands may be secured to separate central members 20 each received by a distinct central member receiver 22 (FIG. 1*e*).

Figure 2B:
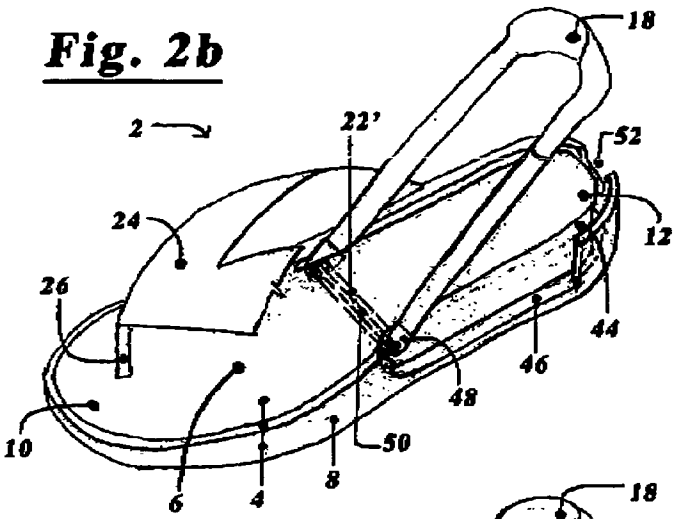
FIG. 2*b* is an angled 3-D perspective partial cut-away view of an interchangeable flip-flop/sandal comprising a heel band, forefoot cover and a receiving element comprising a slot in the heel portion of the sole, with the heel band in the second in-use position in accordance with one embodiment of the present disclosure.
Figure 2D:
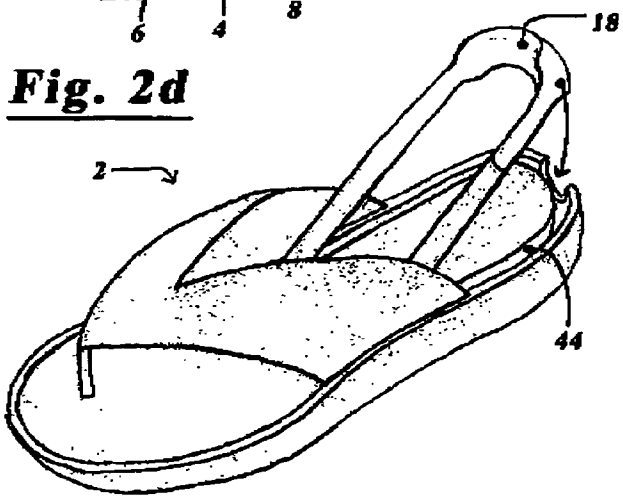
FIG. 2*d* is an angled 3-D perspective view of an interchangeable flip-flop/sandal comprising a heel band, forefoot cover and a receiving element comprising a slot in the heel portion of the sole, with the heel band in the second in-use position in accordance with one embodiment of the present disclosure.
Figure 2G:
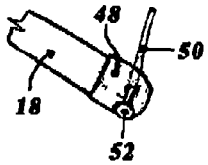
FIG. 2*g* is a one half sided 3-D perspective view of one embodiment of the central member in accordance with one embodiment of the present disclosure.
Figure 3B:
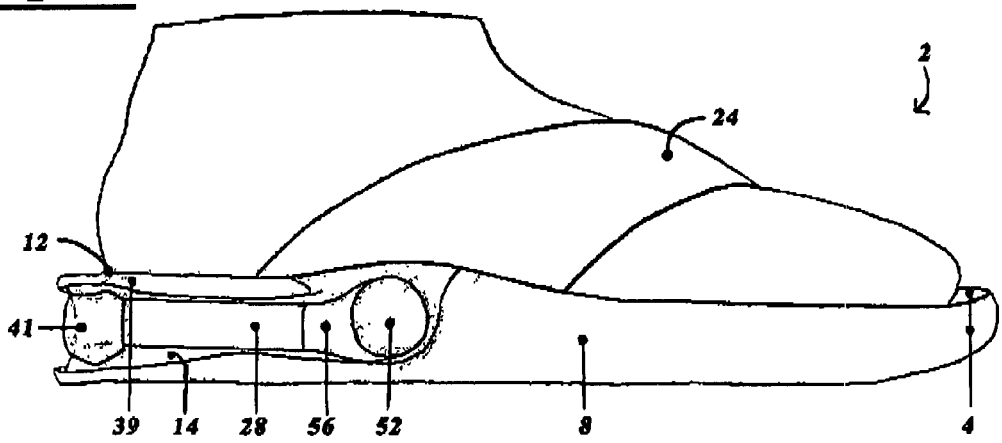
FIG. 3*b* is a side view elevation of an alternate embodiment of an interchangeable flip-flop/sandal showing the heel band and forefoot band in communication with a single central member with the heel band and forefoot band in lowered positions in accordance with one embodiment of the present disclosure.
Figure 3C:
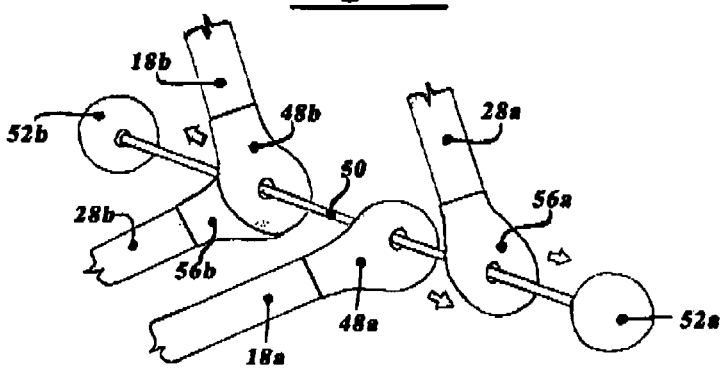
FIG. 3*c* is a 3-D perspective view of one embodiment of the central member in accordance with one embodiment of the present disclosure.

An alternate embodiment of the central member 20 and its attachment to the heel 18 and/or forefoot 28 bands is shown in FIGS. 2*b* and *f-g* and 3 *a-c*. In this embodiment, the central member is illustrated as elongate member 50 with knob 52 (knob 52 may be considered a band securing member). This embodiment of the central member functions as discussed above and offers the additional advantage that the heel 18 and forefoot 28 bands are rotatably secured around the central member 50. As can be seen in FIGS. 2*g* and 3*c*, the heel band 18 has an opening in each of the connecting members (designated 48*a* and 48*b*) of the band to receive the elongate member 50 so that the heel bands are rotatable around the elongate member 50. Similar openings are present in each of the connecting members of the forefoot band 28 (designated 56*a* and 56*b*). The opening through the connecting members of the heel 18 and forefoot 28 bands may have a slightly greater diameter than the elongate member 50 to allow the heel 18 and forefoot 28 bands to freely rotate upon the elongate member 50. The knob 52 secures the heel 18 and/or forefoot 28 bands to the elongate member 50. The knob 52 may be secured to the elongate member 50 by any means known in the art. In one embodiment, the knob 52 may be reversibly secured to the elongate member 50 so that the knob 52 and/or various components of the interchangeable flip-flop/sandal's parts, such as but not limited to the heel 18 and/or forefoot 28 bands may be interchanged.

The elongate member 50 may be rotatably received and secured by the central member receiver 22 as described above. As FIG. 2*g* illustrates, the body of the elongate member 50 may be cylindrical in shape with a length slightly greater than that of the central member receiver 22. However, the elongate member may be of any shape desired. The elongate member 50 and knob 52 may be constructed from materials such as metals, rubber, plastic, synthetic materials, leather or any other durable materials known in the art that have elastic or rigid capabilities. The shape, design or construction method used to create the elongate member 50 and knob 52 be modified or altered to best fit the function of the interchangeable flip-flop/sandal design or the accessories and parts that come with it. FIGS. 2*g* and 3*c* are detailed illustrations of the working parts of the elongate member 50 and knob 52 as described.

As mentioned above, the central member serves as a pivot point for the heel band 18 and/or the forefoot band 28 allowing movement of the heel band 18 and/or the forefoot band 28 between the first stored position and the second in-use position. As shown in FIG. 3*a*, both the heel band 18 and/or the forefoot band 28 may be rotatably secured to a single central member; alternatively, the heel band 18 and/or the forefoot band 28 may each be connected to a separate central member as shown in FIG. 1*e*. When the interchangeable flip-flop/sandal 2 is in flip-flop mode, the heel band 18 and/or the forefoot band 28 are positioned on the receiving element or adjacent to the sidewall 14 of the sole 4 and are in the first stored position. When the interchangeable flip-flop sandal is converted to a sandal, the heel band 18 and/or the forefoot band 28 is moved from the first stored position to the second in-use position by moving heel band 18 and/or the forefoot band 28 to its/their desired position. In making such a transition, in embodiments where the heel band 18 and/or the forefoot band 28 are non-rotatably secured to the central member 20, the central member 20 rotates within the central member receiver 22; in embodiments where the heel band 18 and/or the forefoot band 28 are rotatably secured to the central member 20, the heel band 18 and/or the forefoot band 28 may rotate around the central member 20, either with or without rotation of the central member 20 within the central member receiver 22. In returning the interchangeable flip-flop sandal back to the first stored position, the heel band 18 may be rotated into the first stored position first or the forefoot band 28 may be rotated to the first stored position first. In one embodiment, the heel band 18 is rotated into the first stored position first, followed by the forefoot band 28. In this embodiment, the forefoot band 28 may be positioned over the heel band 18 so that only the forefoot band is visible (see FIGS. 1*e-f* and 3*b*).

In any of the embodiments above, the central member 20 runs parallel to the long axis of the central member receiver 22 and extends between the openings formed by the central member receiver 22.

Heel Band and Forefoot Band

In one embodiment of the present disclosure, the flip-flop/sandal 2 comprises a heel band 18 to secure the heel portion of the user's foot and prevent the motion of vertical lift between the user's heel and the heel section 12 of the flip-flop/sandal 2. The design and placement of the heel band 18 may be varied provided that the heel band 18 provides the aforementioned function. Various embodiments of the placement of the heel band 18 are provided in the figures (see for example, FIGS. 1*d-i* and 2*a, b* and *d*). As shown in FIG. 1*d*, the heel band 18 may be positioned around the rear portion of the user's heel. When in position (the second in-use position), the heel band 18 may be used to further secure the heel of the user's foot to the foot bed 6 of the flip-flop/sandal 2.

In an alternative embodiment of the present disclosure, the flip-flop/sandal 2 may also have a forefoot band 28, that operates with the heel band 18 to secure the heel portion of the user's foot and prevent the motion of vertical lift between the user's heel and the heel section 12 of the flip-flop/sandal 2. The design and placement of the heel band 18 in this dual band version of the flip-flop/sandal 2 is the same as that of the heel band 18 in the flip-flop/sandal 2 previously described. As shown in FIGS. 1*e* and *j*, the forefoot band 28 may be positioned over the upper most part of the user's forefoot arch area of the foot. When in position (the second in-use position), the forefoot band 28 may be used to further secure the heel and central portions of the user's foot to the foot bed 6 of the flip-flop/sandal 2.

Figure 4A:
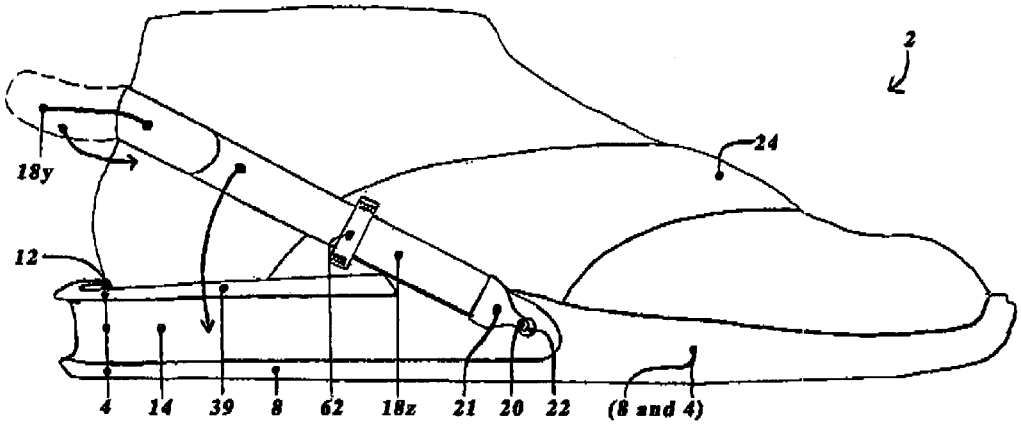
FIG. 4*a* is a side view elevation of an interchangeable flip-flop/sandal with the heel band in an upright position in accordance with one embodiment of the present disclosure.
Figure 4B:
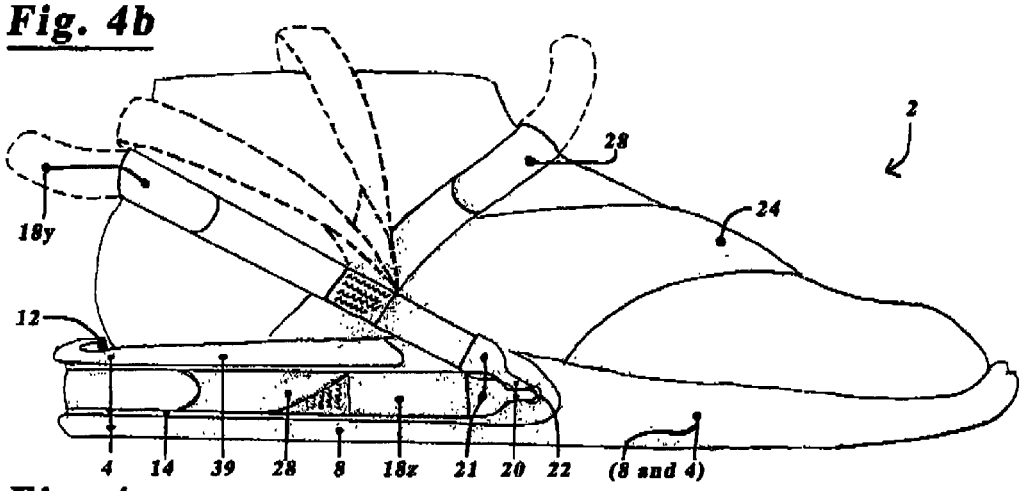
FIG. 4*b* is a side view elevation of an interchangeable flip-flop/sandal showing both the upright and lowered positions of the heel and forefoot bands in accordance with one embodiment of the present disclosure.
Figure 4C:
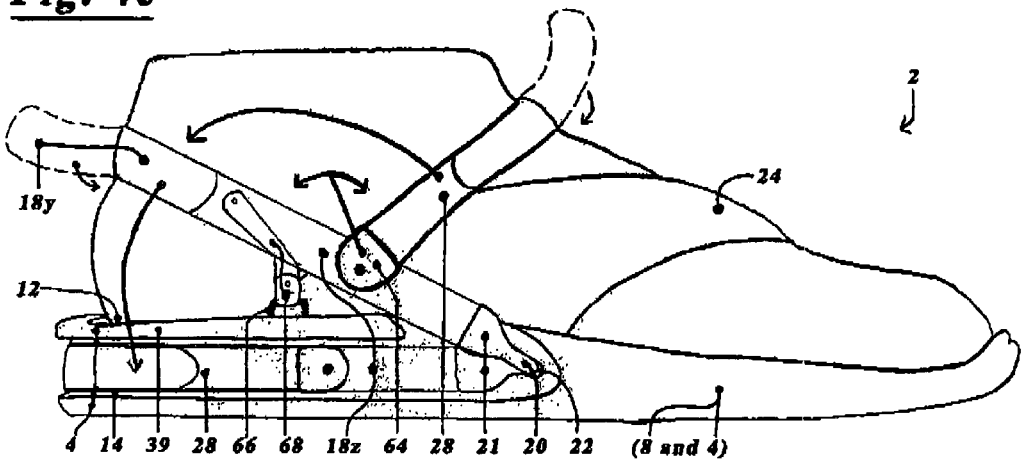
FIG. 4*c* is a side view elevation of an interchangeable flip-flop/sandal showing both the upright and lowered positions of the heel and forefoot bands in accordance with one embodiment of the present disclosure.

In yet another alternative embodiment of the disclosure, the forefoot band 28 may be movably secured using attachment methods known in the art to a portion of the heel band 18, as illustrated in FIG. 4*b*, so that a combination foot band unit is formed. When worn as a flip-flop, the forefoot band 28 may be designed to fold over onto the heel band 18 and placed around the sidewall 14. In a variant embodiment, as illustrated in FIG. 4*c*, the forefoot band 28 may be rotatably connected to the heel band 18 via a forefoot band connector 64. The forefoot band connector 64 may have the ability to pivot forwards and backwards. The forefoot band 28, is designed to flip over onto the heel band 18 in the heel section 12 of the sole 4 when the flip-flop/sandal 2 is worn as a flip-flop.

The heel band 18 and/or the forefoot band 28 may be in removably secured or non-removably secured with the central member using any of the various attachment methods known to the art as discussed above. FIG. 1*c* illustrates a heel band 18 non-removably secured to both ends of the central member, designated in this figure as 20. The heel band 18 operates to secure the upper heel portion of the user's foot when the interchangeable flip-flop/sandal 2 is worn as a sandal, preventing vertical motion and lift between the heel of the user's foot and the heel section 12 of the convertible flip-flop/sandal 2. The heel band 18 may be one solid band. In an alternative embodiment, there may be a first heel band 18*z* and a second heel band 18*y* that may be connected to form one band around the user's heel (FIGS. 4*a-c*). The heel band 18 may be made of rigid or elastic webbing materials, leathers, synthetic materials or any other material known to the art. The physical dimensions of the heel band 18 may be adjusted or modified to fit the comfort requirements for the contoured dimensions of the upper heel and ankle portions of the human foot. In addition the heel band's 18 perimeter or length may be modified in shape and design and may be adjusted to form a tight and secure fit around the heel and ankle portions of the user's foot. FIG. 4*a* illustrates, first and second heel bands 18*z* and 18*y* are adjustable with the use of hook-loop fastener (such as Velcro), although other materials may be used. Adjustment methods may vary, and include methods such as a hook-loop fastener, buckles, buttons, clips, snaps, fasteners, magnets, latches or any other means that are known within the art which can tighten or control the length of the perimeter of the heel band 18. The foregoing may also apply to the forefront band 28, as also illustrated in FIGS. 4*a-c*.

In a variation of the embodiment of the disclosure, the heel band 18 may have a heel band abrasion pad 42 attached to it using conventional methods known in the art to prevent abrasion to the user's heel (FIG. 3*a*). The heel band abrasion pad 42 may be constructed of elastic materials or materials that have padding or cushioning that can be made from synthetic or non-synthetic materials known to the art. The shape or design of the heel band abrasion pad 42 may be modified to best fit the upper heel contours of the human foot. A forefoot band abrasion pad 41 is also illustrated in FIG. 3*a* and the above descriptions are equally applicable to the forefoot band abrasion pad 41.

In an alternative embodiment of the disclosure, a loop 62 may be secured to the lower rear portion of each side of the forefoot cover 24 that the heel band 18 may pass through, as FIG. 4*a* illustrates. The heel band 18 may pass through the loops 62 preventing upward motion of the heel band 18.

In an alternative embodiment of the disclosure, a sole loop 66 may be secured within the heel section 12 of the sole 4. As illustrated in FIG. 4*c*, the sole loop 66 may extend out from the foot bed 6 of the sole 4 and connect with a security strap 68 that may be attached to the heel band 18. This feature may further prevent upward motion of the heel band 18.

Receiving Element

When the interchangeable flip-flop/sandal 2 is worn as a flip-flop, the heel band 18 and/or the forefoot band 28 may be placed in the first stored position, with the heel band 18 and/or the forefoot band 28 resting on or adjacent to the receiving element 16. In one embodiment, the receiving element 16 is a ledge, shelf or similar structure formed along at least a portion of the sidewall, said ledge, shelf or similar structure being sized to reversibly store the heel 18 and/or forefoot 28 bands. In this first stored position, the heel band 18 and/or the forefoot band 28 is also in contact with or adjacent to the sidewall 14. The sidewall 14 may be take on a number of shapes adjacent to or near the receiving element 16. The portion of the heel portion adjacent to the receiving element 16 may have a concave, convex or angled shape along at least a portion of the receiving element in order to aid in storing the heel 18 and or forefoot 28 bands. For example, a concave, convex or angled shape provides extra slip resistance for the heel band 18 and/or forefoot band 28.

Figure 1G:
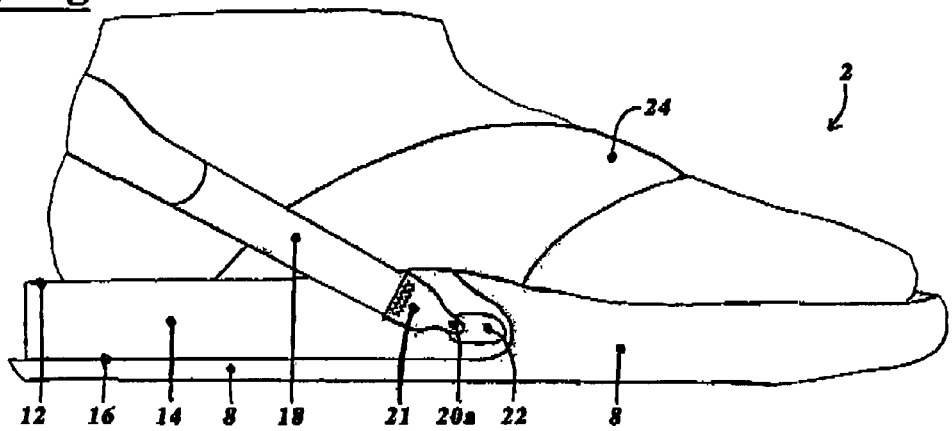
FIG. 1*g* is a side view elevation of an interchangeable flip-flop/sandal comprising a heel band, forefoot cover and a receiving element having a vertical heel portion adjacent thereto, with the heel band in the second in-use position in accordance with one embodiment of the present disclosure.
Figure 1H:
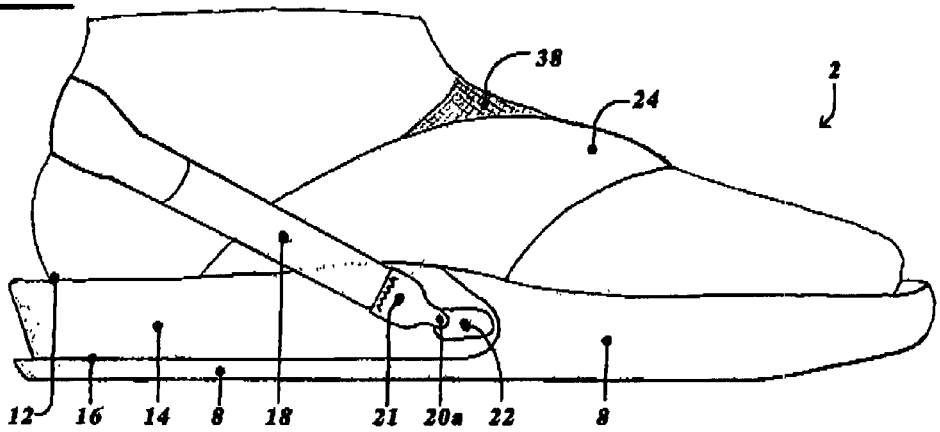
FIG. 1*h* is a side view elevation of an interchangeable flip-flop/sandal comprising a heel band, forefoot cover with the forefoot cover extension and a receiving element having an angled heel portion adjacent thereto, with the heel band in the second in-use position in accordance with one embodiment of the present disclosure.
Figure 1I:
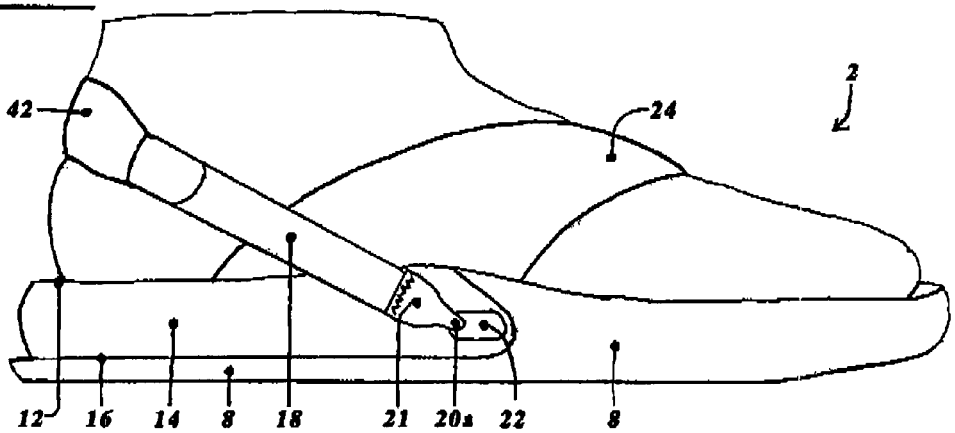
FIG. 1*n* is a side view elevation of an interchangeable flip-flop/sandal comprising a heel band, forefoot cover and a receiving element having a convex heel portion adjacent thereto, with the heel band in the second in-use position in accordance with one embodiment of the present disclosure.
FIG. 1*j* consists of three side view elevations of an interchangeable flip-flop/sandal in accordance with one example of the present disclosure. The top view shows the heel band in the second in-use position. The middle view shows the heel band and forefoot band in the second in-use position. The bottom view shows the heel band or a heel band and forefoot band combination in the first stored position.
Figure 1J:
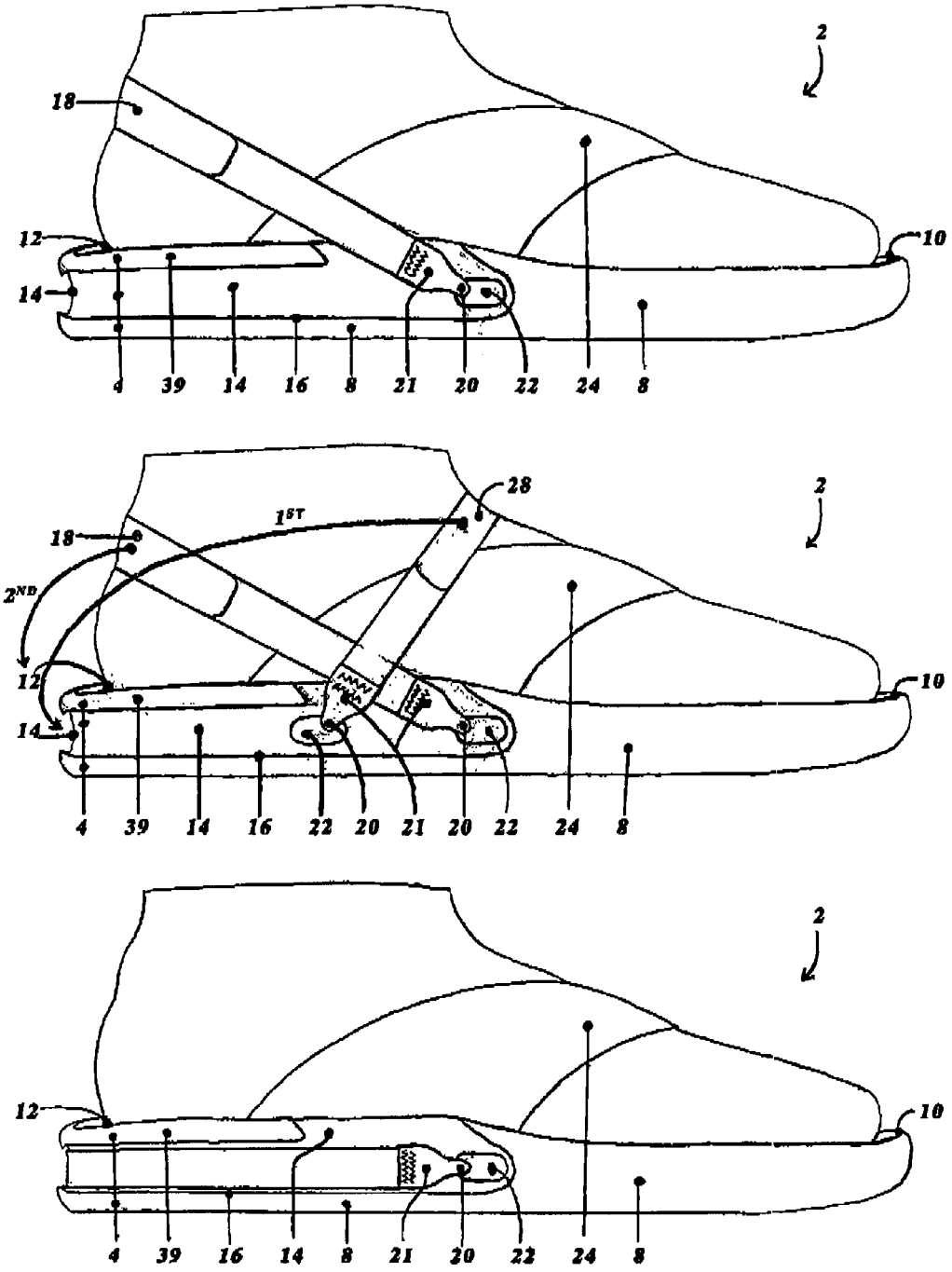

A concave shape of the sidewall is shown in FIGS. 1*d-f*, 1*j*, 3*a-b* and 4*a-c*; a convex shape of the sidewall is shown in FIG. 1*i*; an angled shape of the sidewall is shown in FIG. 1*h*; a perpendicular (with respect to the receiving element 16) shape for the sidewall is shown in FIG. 1*g*.

In various embodiments of the disclosure, the sidewall 14 may have different shapes. For example, in one embodiment illustrated in FIG. 1*g*, the sidewall 14 may be perpendicular to the receiving element 16. In another embodiment, as illustrated in FIG. 1*h*, the sidewall 14 may be designed with an inward angled wall to the receiving element 16. FIG. 1*i* illustrates another embodiment in which the sidewall 14 is convex in shape. FIGS. 1*d-f*, 3*a-b* and 4*a-c* illustrates another embodiment in which the sidewall 14 is concave in shape. In another embodiment, as illustrated in FIGS. 1*j*, 3*a-b*, 4*a-c*, 5*a, b* and *d*, there may be an additional ledge or upper ledge 39 that overhangs the receiving element 16. The upper ledge 39 is a design addition that may further prevent the upward slipping of the foot bands when they are placed upon the foot bed sidewall 14.

The receiving element 16 provides a platform on which the heel band 18 and/or forefoot band 28 may rest, thereby preventing the heel band 18 and/or forefoot band 28 from sliding or slipping underneath the interchangeable flip-flop/sandal 2 when in the first stored position. In each of the embodiments illustrated, it should be noted that the receiving element 16 does not completely enclose or surround or form a channel for the heel band 18 and/or forefoot band 28. The receiving element 16 serves to support the heel band 18 and/or forefoot band 28 as discussed. In certain embodiments, the shape of the sidewall may function to aid in keeping the heel band 18 and/or forefoot band 28 in position on the receiving element 16.

Figure 2A:
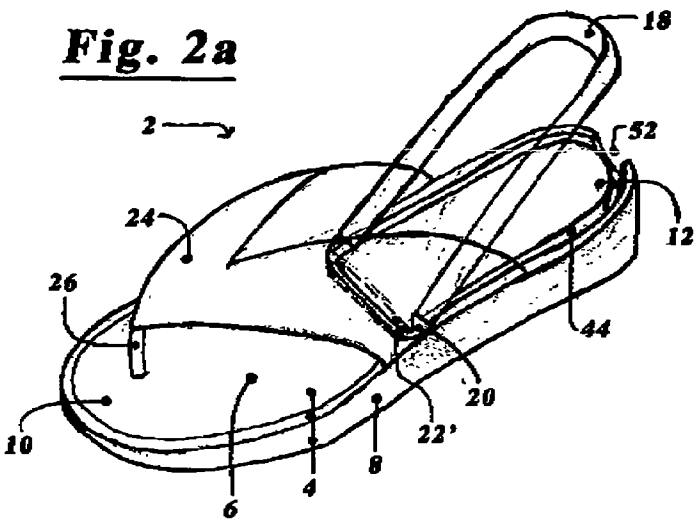
FIG. 2*a* is an angled 3-D perspective partial cut-away view of an interchangeable flip-flop/sandal comprising a heel band, forefoot cover and a receiving element comprising a slot in the heel portion of the sole, with the heel band in the second in-use position in accordance with one embodiment of the present disclosure.
Figure 2C:
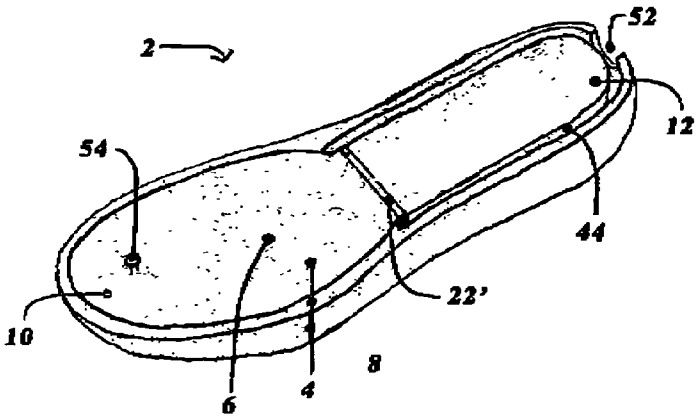
FIG. 2*c* is an angled 3-D perspective view of an interchangeable flip-flop/sandal of FIG. 2*a* illustrating the sole portion and the receiving element in accordance with one example of the present disclosure.
Figure 2E:
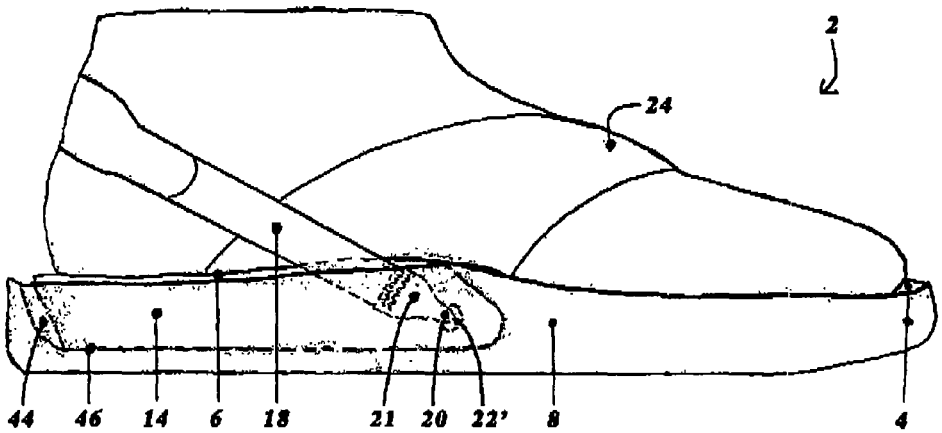
FIG. 2*e* is a side view elevation of an interchangeable flip-flop/sandal comprising a heel band, forefoot cover and a receiving element comprising a slot in the heel portion of the sole, with the heel band in the second in-use position in accordance with one embodiment of the present disclosure. The dashed lines within the sole represent the inside view of the slot.
Figure 2F:
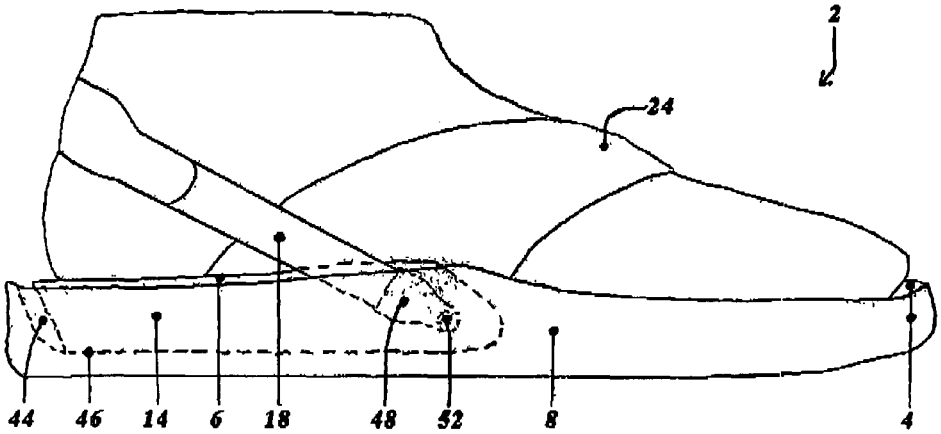
FIG. 2*f* is a side view elevation of an interchangeable flip-flop/sandal comprising an alternate embodiment of the central member, a heel band, a forefoot cover and a receiving element comprising a slot in the heel portion of the sole, with the heel band in the second in-use position in accordance with one embodiment of the present disclosure. The dashed lines within the sole represent the inside view of the slot.

In an alternative embodiment of the disclosure, the flip-flop/sandal 2 may be constructed with a vertical slot 44 interior to the outside perimeter of the heel section 12 of the sole, as demonstrated in FIG. 2*a*. The vertical slot 44 in this embodiment serves as the receiving element and may be constructed wide enough to house the heel band 18, or the heel band 18 and forefoot band 28 combination. In various alternative embodiments, the shape and design of the vertical slot 44 may be modified to best fit the design and function of the heel band 18 or the heel band 18 and forefoot band 28 combination. FIG. 2*b* illustrates the inner part of the vertical slot 44 showing the inner slot ledge 46. The heel band 18 may be inserted into the vertical slot 44 when the flip-flop/sandal 2 is worn as a flip-flop. The heel band 18 may rest upon the inner slot ledge 46 within the vertical slot 44. At the rear edge of the flip-flop/sandal's 2 sole 4 is a band access area 52. The band access area is a void in the rear edge of the heel section 12. The band access area 52 is designed for the purpose of easy band access for inserting or removing the bands in or out of the vertical slot 44 region. The band access area 52 may be U-shaped or modified in shape or design to best fit the design and or operational requirements of the heel band 18 or forefoot band 28. Band access area 52 modifications may also occur by design needs of the sole 4.

Figure 5A:
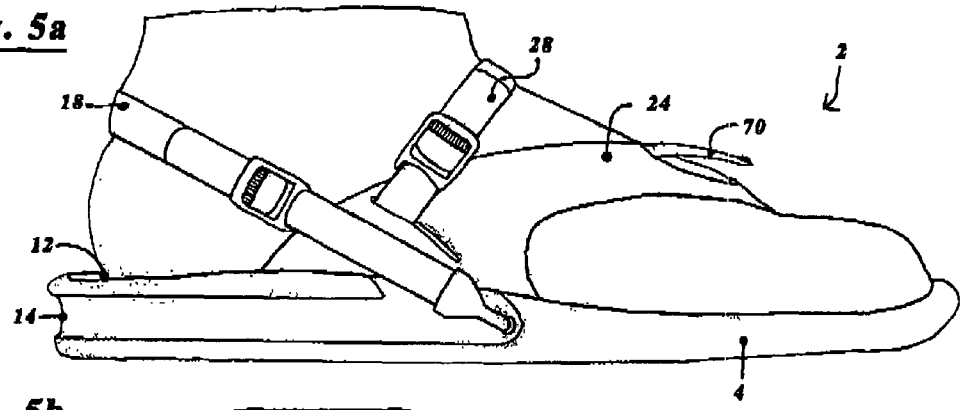
FIG. 5*a* is a side view elevation of an interchangeable flip-flop/sandal with the heel band and forefoot band in upright positions in accordance with one embodiment of the present disclosure.
Figure 5B:
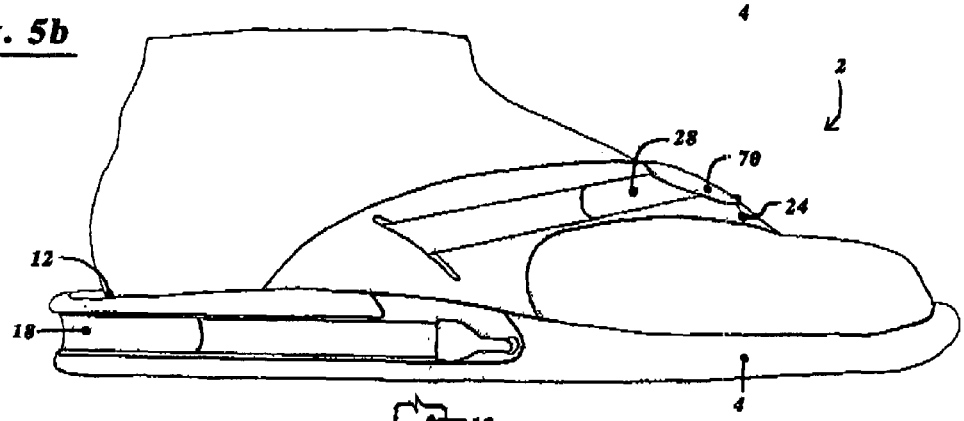
FIG. 5*b* is a side view elevation of an interchangeable flip-flop/sandal with the heel band and forefoot band in lowered positions in accordance with one embodiment of the present disclosure.

In an alternative embodiment, the forefoot band 28 may be attached to a portion of the forefoot cover 24, as illustrated in FIGS. 5*a, b* and *d*. When the user wishes to covert the flip-flop/sandal 2 to be worn as a flip-flop, the forefoot band 28 may be moved forward and secured onto the forefoot cover 24 as demonstrated in FIG. 5*b*. In this embodiment, the first stored position for the forefoot band is the position illustrated in FIG. 5*b*; the first stored position for the heel band is as described. The forefoot band 28 may be adjustable to achieve this purpose (any method of adjustment described herein or known in the art may be used). The forefoot band 28 may be secured to the forefoot cover 24 with a securing element 70. The securing element 70 may be placed at any convenient location on the forefoot cover 24. The securing element 70 may be a one piece or a two piece unit. In embodiments where the securing element 70 is a two piece unit, the first and second pieces are designed to reversibly engage one another as is known in the art.

Figure 5C:
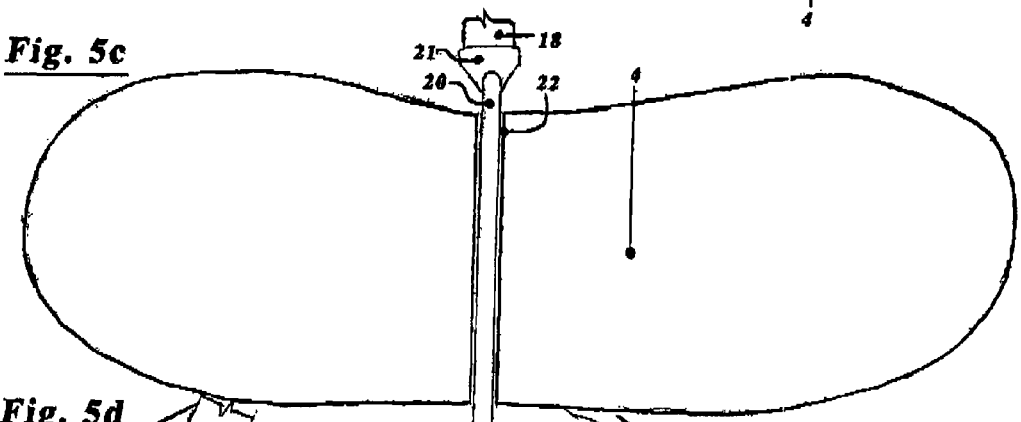
FIG. 5*c* is a cross-section of an interchangeable flip-flop/sandal of FIG. 5*a*.
Figure 5D:
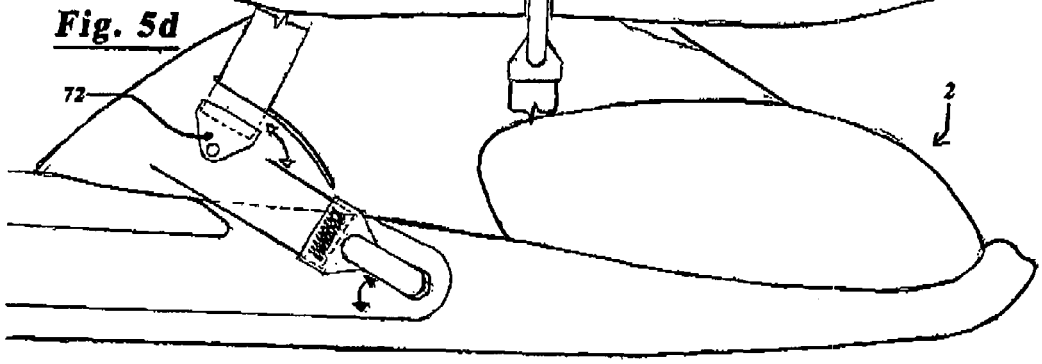
FIG. 5*d* is a partial side view elevation of an interchangeable flip-flop/sandal with the heel band and forefoot band in upright positions in accordance with one embodiment of the present disclosure.

FIG. 5*c* illustrates an embodiment where the central member receiver 22 is a recess along the bottom side of the sole 4. The central member 20 operates as described herein. FIG. 5*d* shows the heel 18 and the forefoot 28 bands in the second position, with the forefoot band 28 being rotatably secured to the heel band 18 via connector 72. When the flip-flop/sandal 2 is converted to be worn in flip-flop mode, the heel band 18 is placed in the first position as described herein and the forefoot band 28 is secured to the forefoot cover 24. When the flip-flop/sandal 2 is converted to be worn in sandal mode, the heel band 18 and the forefoot band 28 are placed in the second position as described herein.

In an alternative embodiment of the disclosure, the central member receiver 22 of the flip-flop/sandal 2 may be lengthened in order to provide movement of the central member 20 in the central member receiver 22. In one embodiment, the central member receiver 22 is extend towards the heel section 12 of the sole 4 (FIG. 6 *a-c*). The elongated central member receiver 22 allows the central member 50 (FIG. 6*c*) to move forwards and backwards within the elongated central member receiver 22.

Figure 6A:
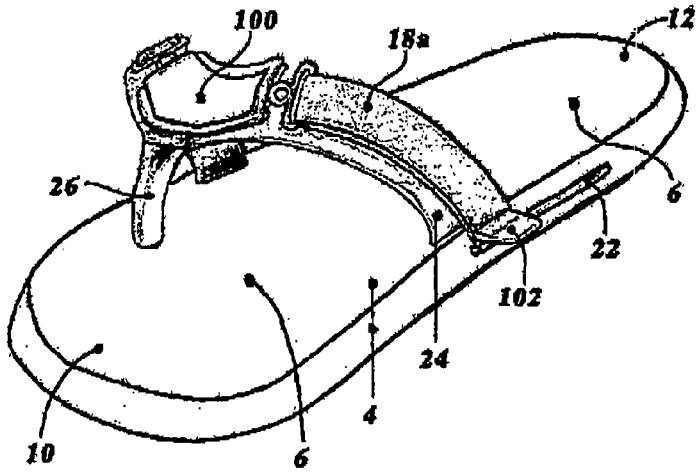
FIG. 6*a* is an angled 3-D perspective view of an interchangeable flip-flop/sandal comprising a forefoot cover, two heel bands, a forefoot cover pad and a central member with the heel bands in the first stored position in accordance with one embodiment of the present disclosure.

FIG. 6*a* shows an embodiment of the interchangeable flip-flop sandal 2 illustrating the elongated central member receiver 22. In FIG. 6*a* the sandal 2 comprises 2 heel bands designated 18*a* and 18*b*. Both heel bands 18*a* and 18*b* extend upwards and loop through connectors located on the left and right ends of the central forefoot pad 100. Attached at the lower ends of the heel bands 18*a* and 18*b* are heel band connectors 48. Attached at the upper ends of the heel bands 18*a* and 18*b* are heel band connector 102 which are a complementary connectors to secure the heel bands 18*a* and 18*b* together when in the second in-use position. The heel band connectors 102 may be any complementary connectors known in the art, such as hook-loop connectors systems, clips.

Figure 6B:
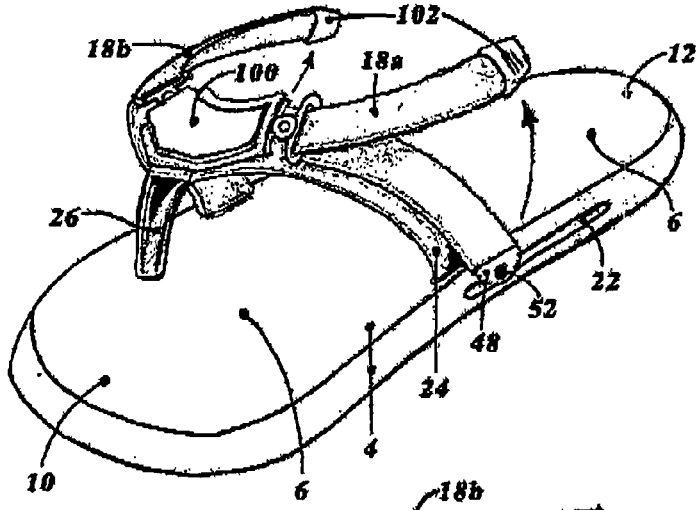
FIG. 6*b* is an angled 3-D perspective view of the interchangeable flip-flop/sandal of FIG. 6*a* illustrating conversion of the heel bands from the first stored position to the second in-use position in accordance with one embodiment of the present disclosure.
Figure 6C:
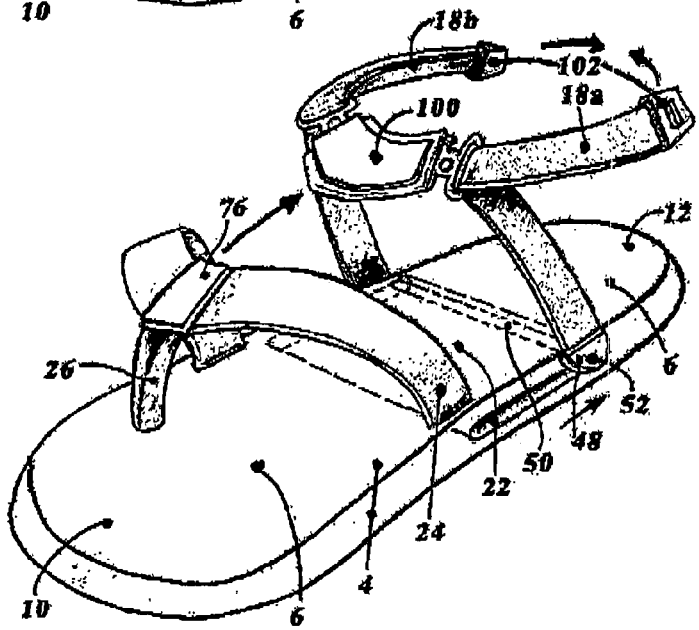
FIG. 6*c* is an angled 3-D perspective view of an interchangeable flip-flop/sandal of FIG. 6*a* illustrating the heel bands in the second in-use position in accordance with one embodiment of the present disclosure.

The central member 50 is in communication with the heel band connectors 48 on the heel bands 18*a* and 18*b*. As the central member 50 is in communication with the heel bands 18*a* and 18*b*, the heel bands are capable of movement with the central member 50. Therefore, the heel bands 18*a* and 18*b* can be moved along the length of the central member receiver 22. The heel band connectors may be attached to the central member 50 be any means known in the art. In one embodiment the heel bands 18*a* and 18*b* are rotatably connected to the central member 50. FIGS. 6*a-c* illustrate the attachment using a elements 52 located on the central member 50. The elements 52 are secured by an opening in the heel band connectors 48. The diameter of the openings located within the heel band connecters 48 may be slightly greater than that of the circumference of the central member 50 in order for the heel band connecters 48 to be rotatably attached. In addition the circumference of the element 52 may be greater than that; of the opening in the heel band connecter 48 openings in order for the heel band connecters 48 to be in secure communication with the central member 50 (FIGS. 6*a-c*).

In flip-flop mode (FIGS. 6*a* and *b*) the central member 50 slides forwards to the front of the central member receiver 22 moving the heel bands 18*a* and 18*b* forward as well. The heel bands 18*a* and 18*b* then reversible attach to the forefoot cover 24 with the central forefoot pad 100 attaching to the forefoot cover connecter 76 (FIG. 6*c*) located on the forefoot cover 24. The heel band connector 102 are reversibly secured to the heel band connecters 48. In this position, the heel bands 18*a* and 18*b* are in the first stored position and the forefoot cover connector is the receiving element.

In sandal mode (FIG. 6*c*) the central member 50 slides backwards to the rear of the central member receiver 22 moving the heel bands 18*a* and 18*b* backwards towards the heel section 12. The central forefoot pad 100 is positioned upon the upper arched forefoot portion of the user's foot and heel bands 18*a* and 18*b* wrap around the user's upper ankle and connect upon the back side of user's upper ankle (FIG. 6*c*) via the heel band connector 102. Arrows in FIGS. 6*b* and 6*c* indicate the direction and path of the flip-flop/sandal's 2 parts in the previously described conversion. In this position, the heel bands 18*a* and 18*b* are in the second in-use position. To convert the flip-flop/sandal 2 from the sandal mode to the flip-flop mode (FIG. 6*a*) the procedure above is simply reversed.

While the disclosure has been described with respect to a limited number of embodiments, those skilled in the art, having benefit of this disclosure, will appreciate that other embodiments can be devised which do not depart from the scope of the disclosure as disclosed here. Accordingly, the scope of the disclosure should be limited only by the attached claims.

The invention claimed is:

1. A footwear capable of interchanging between a flip-flop and a sandal, said footwear comprising:

a. a sole comprising a top portion, a bottom portion, a forefoot portion, a heel portion and a sidewall portion;

b. a central member rotatably received and secured in a central member receiver positioned in said sole;

c. a heel band capable of interconversion between a first stored position and a second in-use position, the heel band being rotatably secured or non-rotatably secured to the central member;

d. a receiving element positioned at least along a portion of the sidewall to receive the heel band when the heel band is in the first stored position; and e. a forefoot cover positioned over at least a part of the forefoot portion, said forefoot cover being secured to the sole.

2. The footwear of claim 1 where the heel band is adjustable and comprises a single band or two or more bands reversible secured to one another.

3. The footwear of claim 1 where the central member is reversibly secured to at least one end of the heel band.

4. The footwear of claim 1 where the central member serves as a pivot point for movement of the heel band between the first stored position and the second in-use position.

5. The footwear of claim 1 where the central member comprises an elongate member and a band connecting member rotatably or non-rotatably secured on each end of the elongate member and each band connecting member being rotatably or non-rotatably secured to the heel band.

6. The footwear of claim 5 where at least one of the band connecting members are reversible secured to the elongate member, the heel band or both the elongate member and the heel band.

7. The footwear of claim 1 where the central member receiver has a size sufficient for the heel band to pass through the central member receiver.

8. The footwear of claim 1 where the central member receiver is a cavity, the cavity extending laterally through the sole and forming an opening on each of the left and right side of the sole.

9. The footwear of claim 1 where the central member receiver is an indentation, the indentation extending laterally across the top or bottom portion of the sole and forming an opening on each of the left and right side of the sole.

10. The footwear of claim 1 where the central member receiver is a cavity, the cavity extending laterally through the sole and forming an opening on each of the left and right side of the sole and extending horizontally along at least a portion of the long axis of the sole, the central member being movable along the long axis of the sole in the cavity.

11. The footwear of claim 1 where the receiving element comprises a platform formed along at least a portion of said sidewall.

12. The footwear of claim 11 where at least a portion of said sidewall adjacent to said platform has a shape to aid in receiving and securing the heel band.

13. The footwear of claim 12 where said shape is selected from the group consisting of concave, convex, perpendicular, angled and overhanging.

14. The footwear of claim 11 where the receiving element comprises a ledge positioned above at least a portion of said platform.

15. The footwear of claim 1 where the receiving element comprises a vertical slot positioned interior to the outside perimeter of the heel section of the sole.

16. A footwear capable of interchanging between a flip-flop and a sandal, said footwear comprising:

a. a sole comprising a top portion, a bottom portion, a forefoot portion, a heel portion and a sidewall portion;

b. a central member rotatably received and secured in a central member receiver positioned in said sole;

c. a heel band capable of interconversion between a first stored position and a second in-use position, the heel band being rotatably secured or non-rotatably secured to the central member;

d. a forefoot band capable of interconversion between a first stored position and a second in-use position, the forefoot band being rotatably secured or non-rotatably secured to the central member, the heel band or both the heel band and the central member;

e. a receiving element positioned at least along a portion of the sidewall to receive at least one of the heel band or forefoot band when the heel band or forefoot band is in the first stored position; and f. a forefoot cover positioned over at least a part of the forefoot portion, said forefoot cover being secured to the sole.

17. The footwear of claim 16 where the first and second central member receivers are an indentation, with each indentation extending laterally across the top or bottom portion of the sole and forming an opening on each of the left and right side of the sole.

18. The footwear of claim 16 where the first and second central member receivers are a cavity, with each cavity extending laterally through the sole and forming an opening on each of the left and right side of the sole and extending horizontally along at least a portion of the long axis of the sole, the first and second central member receivers being movable along the long axis of the sole in the cavity.

19. The footwear of claim 16 where the heel band and forefoot band are adjustable and each of the heel band and forefoot band comprises a single band or two or more bands reversible secured to one another.

20. The footwear of claim 16 where the central member is reversibly secured to at least one end of the heel band, the forefoot band or both the heel band and the forefoot band.

21. The footwear of claim 16 where the central member serves as a pivot point for movement of at least one of the heel band and the forefoot band between the first stored position and the second in-use position.

22. The footwear of claim 16 where the central member receiver has a size sufficient for the heel band and forefoot band to pass through the central member receiver.

23. The footwear of claim 16 where the central member receiver is a cavity, the cavity extending laterally through the sole and forming an opening on each of the left and right side of the sole.

24. The footwear of claim 16 where the central member receiver is an indentation, the indentation extending laterally across the top or bottom portion of the sole and forming an opening on each of the left and right side of the sole.

25. The footwear of claim 16 where the central member receiver is a cavity, the cavity extending laterally through the sole and forming an opening on each of the left and right side of the sole and extending horizontally along at least a portion of the long axis of the sole, the central member being movable along the long axis of the sole in the cavity.

26. The footwear of claim 16 where the receiving element comprises a platform formed along at least a portion of said sidewall.

27. The footwear of claim 26 where at least a portion of said sidewall adjacent to said platform has a shape to aid in receiving and securing the heel band.

28. The footwear of claim 27 where said shape is selected from the group consisting of concave, convex, perpendicular, angled and overhanging.

29. The footwear of claim 26 where the receiving element comprises a ledge positioned above at least a portion of said platform.

30. The footwear of claim 16 where the receiving element comprises a vertical slot positioned interior to the outside perimeter of the heel section of the sole.

31. A footwear capable of interchanging between a flip-flop and a sandal, said footwear comprising:

a. a sole comprising a top portion, a bottom portion, a forefoot portion, a heel portion and a sidewall portion;

b. a first central member rotatably received and secured in a first central member receiver positioned in said sole;

c. a second central member rotatably received and secured in a second central member receiver positioned in said sole;

d. a heel band capable of interconversion between a first stored position and a second in-use position, the heel band being rotatably secured or non-rotatably secured to the first central member;

e. a forefoot band capable of interconversion between a first stored position and a second in-use position, the forefoot band being rotatably secured or non-rotatably secured to the second central member, the heel band or both the heel band and the second central member;

f. a receiving element positioned at least along a portion of the sidewall to receive at least one of the heel band or forefoot band when the heel band or forefoot band is in the first stored position; and g. a forefoot cover positioned over at least a part of the forefoot portion, said forefoot cover being secured to the sole.

32. The footwear of claim 31 where the heel band and forefoot band are adjustable and each of the heel band and forefoot band comprises a single band or two or more bands reversible secured to one another.

33. The footwear of claim 31 where the first central member is reversibly secured to at least one end of the heel band and the second central member is reversibly secured to at least one end of the forefoot band.

34. The footwear of claim 31 where the first central member serves as a pivot point for movement of the heel band between the first stored position and the second in-use position and the second central member serves as a pivot point for movement of the forefoot band between the first stored position and the second in-use position.

35. The footwear of claim 31 where the first central member receiver has a size sufficient for the heel band to pass through the first central member receiver and the second central member receiver has a size sufficient for the forefoot band to pass through the second central member receiver.

36. The footwear of claim 31 where the first and second central member receivers are a cavity, with each cavity extending laterally through the sole and forming an opening on each of the left and right side of the sole.

37. The footwear of claim 31 where the receiving element comprises a platform formed along at least a portion of said sidewall.

38. The footwear of claim 37 where at least a portion of said sidewall adjacent to said platform has a shape to aid in receiving and securing the heel band.

39. The footwear of claim 38 where said shape is selected from the group consisting of concave, convex, perpendicular, angled and overhanging.

40. The footwear of claim 37 where the receiving element comprises a ledge positioned above at least a portion of said platform.

41. The footwear of claim 31 where the receiving element comprises a vertical slot positioned interior to the outside perimeter of the heel section of the sole.

42. The footwear of claim 31 where the forefoot band is rotatably secured or non-rotatably secured to the heel band.

* * * * *